United States Patent [19]

Maier

[11] Patent Number: 5,060,993

[45] Date of Patent: Oct. 29, 1991

[54] LOCKING MECHANISM FOR BURIAL CASKET

[75] Inventor: Donald R. Maier, Batesville, Ind.

[73] Assignee: Batesville Casket Company, Inc., Batesville, Ind.

[21] Appl. No.: 617,589

[22] Filed: Nov. 26, 1990

[51] Int. Cl.[5] ..... E05C 3/04

[52] U.S. Cl. ..... 292/241; 27/DIG. 1; 292/103; 292/204; 292/240; 52/127.9

[58] Field of Search ..... 52/127.9 , 139, 124.1; 27/DIG. 1; 292/101, 202, 204, 103, 240, 241, 104

[56] References Cited

U.S. PATENT DOCUMENTS

| | | | |
|---|---|---|---|
| 584,343 | 6/1897 | Froelich | 292/103 |
| 1,807,236 | 5/1931 | Clark | 27/DIG. 1 |
| 2,506,553 | 5/1950 | Slaughter, Jr. et al. | 27/DIG. 1 |
| 2,607,102 | 8/1952 | Slaughter, Jr. | 292/240 |
| 2,666,248 | 1/1954 | Slaughter, Jr. | 292/240 |
| 2,708,302 | 5/1955 | Wilkirson | 292/240 |
| 3,048,435 | 8/1962 | De Marco | 27/DIG. 1 |
| 3,224,066 | 12/1965 | Overland | 292/240 |

FOREIGN PATENT DOCUMENTS

| | | | |
|---|---|---|---|
| 159618 | 5/1964 | U.S.S.R. | 52/127.9 |
| 516922 | 1/1940 | United Kingdom | 292/103 |

*Primary Examiner*—Eric K. Nicholson
*Assistant Examiner*—Darnell M. Boucher
*Attorney, Agent, or Firm*—Wood, Herron & Evans

[57] ABSTRACT

Locking mechanism for burial caskets in which a rod extending into the outer wall of the casket shell rotates a latch having a hook-like arm extending above the upper edge of the casket shell and provided with a cam surface which engages a keeper member on a matching edge of the casket cap to pull the cap tightly against the shell.

14 Claims, 2 Drawing Sheets

LOCKING MECHANISM FOR BURIAL CASKET

BACKGROUND OF THE INVENTION

This invention relates to locking mechanisms for burial caskets, particularly caskets made of wood. Such caskets customarily have a shell or body portion and a cap or cover portion, the two portions fitting closely edge-to-edge when the casket is closed, and one or more locking mechanisms to assure that once the cap is closed, it is held firmly closed against the shell.

One prior latch for a hardwood casket is a push button latch. A catch on the casket body engages a keeper on the cap and is released by pushing on a push button. Another current form of latch has a pivoted lever mounted on the shell. The lever slides in between the cap and shell and slides in and engages a keeper on the cap.

At the time the manufacture of a hardwood casket and installation of its latching mechanism, it is to be expected that the latch mechanism works perfectly and reliably. But wood tends to grow. It absorbs moisture and is affected by variations in temperature in different parts of the country. The wood expands or contracts, warps and bows. The effect of the "growing" of the wood is to cause a misalignment of the latch with its keeper. The latching of the cap to the body or shell of the casket then requires a jostling to a greater or lesser degree of the cap with respect to the shell in order to bring the latch and keeper into alignment.

In funeral practices, the family may wish to witness or even participate in the closing of the casket at the conclusion of the service. Because of the problems referred to above, there is the fear on the part of the funeral director that the cap will not latch easily and gracefully, thereby detracting from the solemnity of the service.

An objective of the present invention has been to provide a latch for a hardwood casket that will allow as much variation in the natural properties of the wood while nevertheless allowing a funeral director to latch the cap to the shell perfectly and reliably.

This objective of the invention is attained by providing a movable latch or bolt, preferably rotatable, that engages a fixed keeper. The latch has a latch surface that is initially spaced from the keeper but gradually moves toward the keeper during rotation of the latch until latching engagement of the keeper is effected. Thereafter, a cam action between latch and keeper takes place that draws the cap snugly down upon the shell of the casket. Therefore, even if there is unusually great movement of the wood of the casket causing misalignment of latch and keeper, the funeral director is assured that upon rotation of the latch, latching will reliably take place.

Another feature of the invention is that the latch assembly requires no screws. Thus, it is easily assembled and can be automated.

Still another feature of the invention consists of the provision of a detent on the latching surface that rides over the keeper, thereby providing both a tactile response and clicking sound so that the funeral director knows that locking has been effected.

According to a preferred embodiment of the present invention, an elongated slot is provided in an edge of the shell which will be contacted by an edge of the cap when the casket is closed.

A hole extends from the outer surface of the shell into communication with the slot and preferably extends beyond the slot into communication with the interior of the casket. The slot receives a rotatable latch having a hook-like arm. The latch has an opening which will be aligned with the hole which communicates with the slot. The latch also has a cam surface on the arm, facing toward the opening in the latch.

A rotatable, elongated locking member is insertable from outside the casket into the hole in the shell wall and into driving engagement with the opening in the latch so that rotation of the locking member rotates the latch.

The facing edge of the cap has keeper means positioned to cooperate with the latch just described. In the preferred embodiment, the keeper means comprises a flat plate screwed to the edge of the cap and set into the edge so as to be flush therewith. The plate has two elongated openings separated by a transverse portion which is engaged by the arm of the latch. The cap edge portion is hollowed out behind the elongated openings and the transverse portion to provide access for the hook-like arm to move around behind said transverse portion.

The cam surface of the hook-like arm has a depression that defines the final position of the keeper, and a vertical face at the end of the cam to prevent overtightening. There is also a projecting detent section on the cam, the detent section engaging the keeper just before the keeper reaches the depression. This section provides a click which assures the user that the mechanism is locked, and also prevents unlocking due to vibration.

In the preferred embodiment, a slotted member is positioned in the elongated slot in the shell, the slotted member conforming closely to the inner surface and depth of the elongated slot. The slotted member receives the latch in its slot, and has a transverse opening to receive the locking member.

Means such as a metal clip are provided on the inner end of the locking member, inside the casket, to prevent the member from slipping out of the shell wall.

When installed, the end surface of the member is flush with the outer surface of the shell. Except at its round, flanged and knurled outer end, the locking member is hexagonal in cross section, as is the opening in the latch. The locking member has an internal hexagonal cross section bore to receive the standard casket key.

The novel locking mechanism accomplishes the objects of the invention, which are to provide a highly dependable locking mechanism which draws the cap tightly to the shell, reduces shifting, prevents overtightening, is asethetic in appearance, and is simple and speedily manufactured and assembled.

BRIEF DESCRIPTION OF THE DRAWINGS

The several features and objectives of the invention will become more readily apparent from the following detailed description taken in conjunction with the accompanying drawings in which.

DETAILED DESCRIPTION OF THE INVENTION

Figure 1:
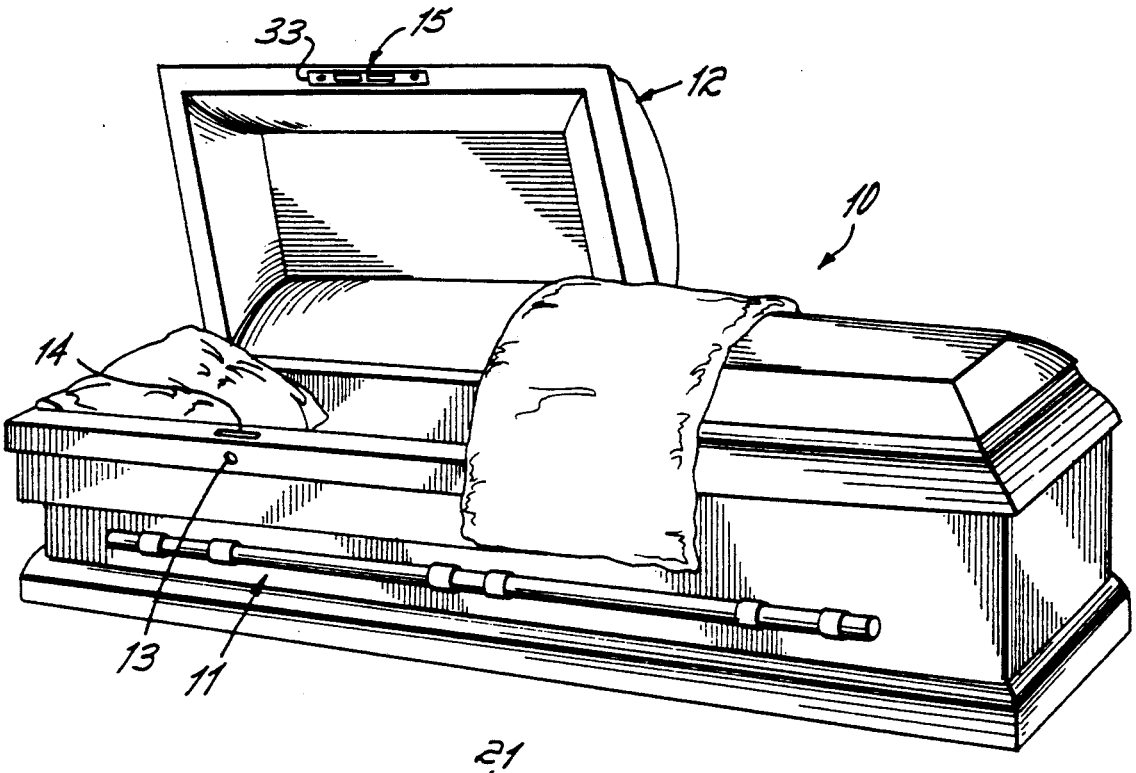
FIG. 1 is a perspective view of a burial casket showing the general location of one of the locking mechanisms for the casket.

FIG. 1 shows a portion of a casket 10 having a shell or body 11 and a cap 12. A hole 13 extends from the outside of the shell through the shell and into communication with the interior of the casket. An elongated slot 14 is provided in the edge of the shell at the location of hole 13 and in communication with the hole. The cooperating part of the locking mechanism is located at 15 in the edge of the cap so as to overlie slot 14 when the cap 12 is closed and the edges of the shell 11 and cap face each other edge-to-edge.

Figure 2:
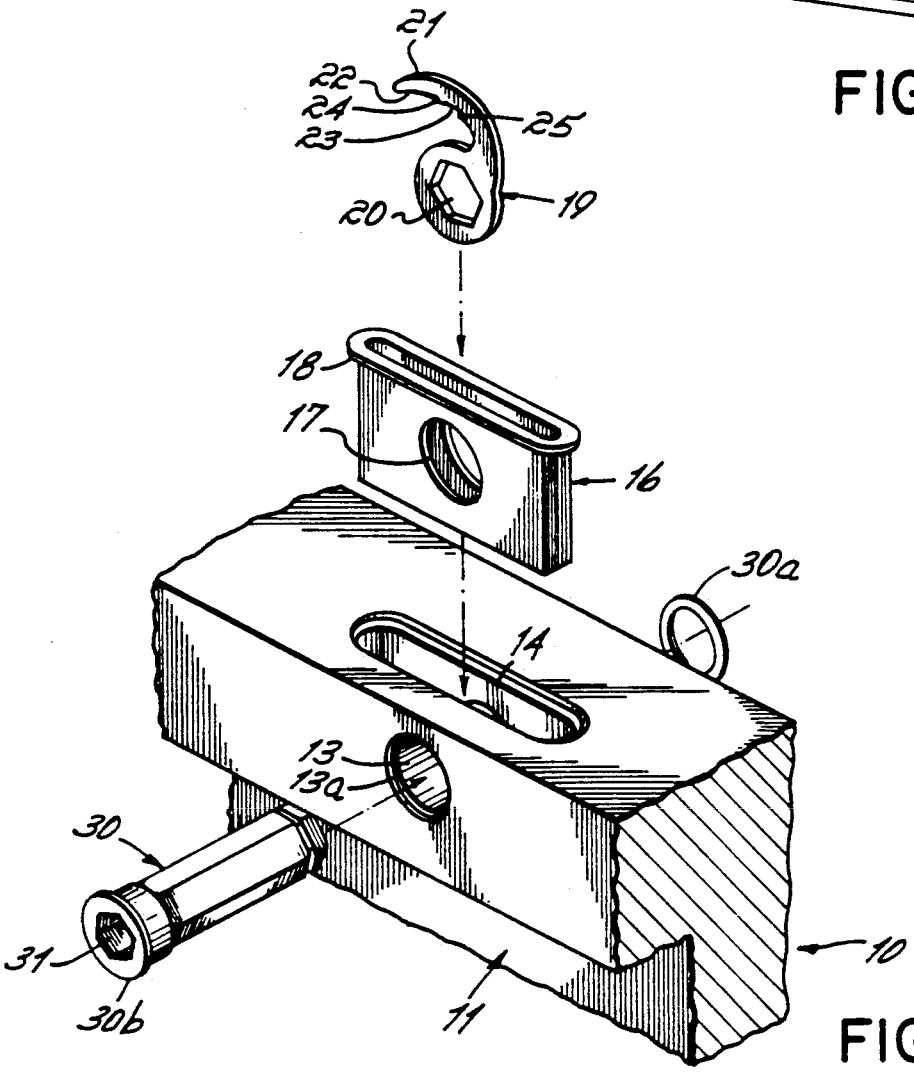
FIG. 2 is an exploded perspective view showing a portion of the casket shell wall, the latch, the locking member, the slotted member which receives the latch, and the clip.

Referring now to FIG. 2, an elongated, slotted member is shown at 16 with a transverse opening 17 therethrough, member 16 being shaped and dimensioned to fit closely within slot 14, with the opening 17 aligned with hole 13. Member 16 is of any suitable material, such as metal, plastic or wood, and may have a narrow flange 18 around all or part of its upper edge to assist in proper location of the member in slot 14.

Figure 3:
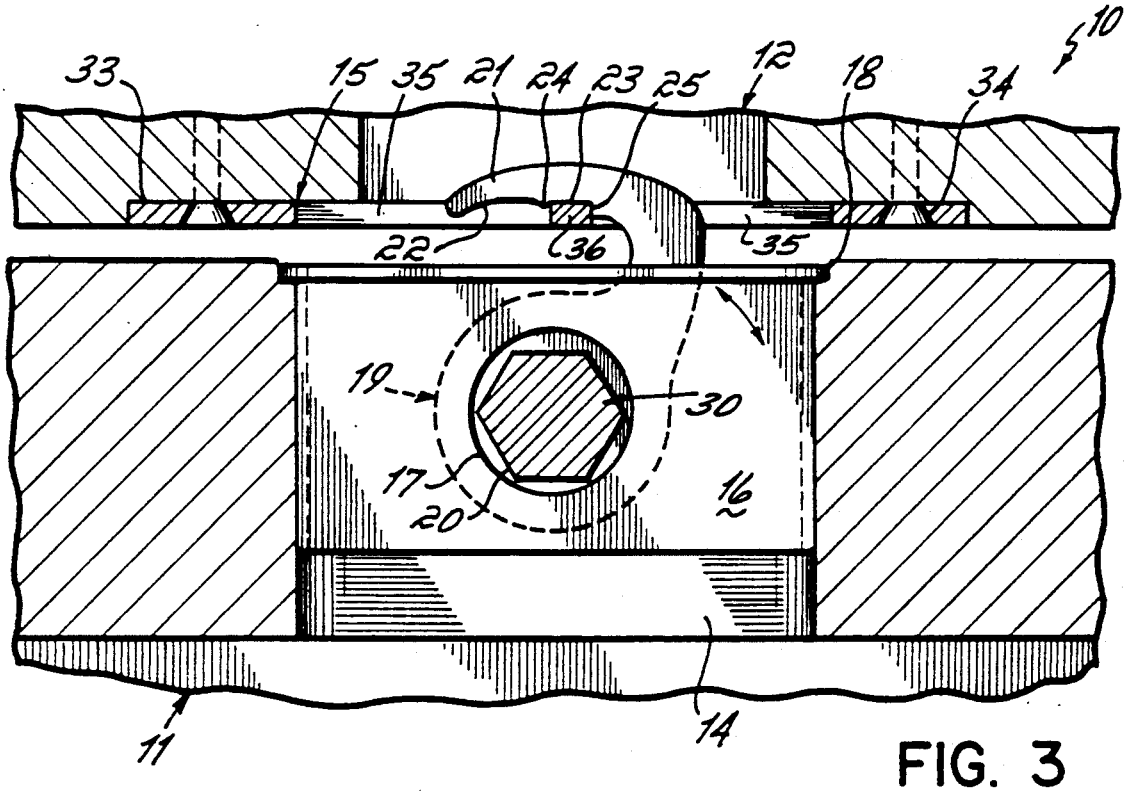
FIG. 3 is an assembled cross-sectional view of the locking mechanism with its hook-like ar engaging the and FIG. 4 is a detail plan view of the keeper which is attached to the cap for engagement by the hook-like member.

Latch mechanism is shown in FIGS. 2 and 3, being in the form of a flat metal member 19 having an opening 20 and a hook-like arm 21, the latter having a cam surface 22 facing generally toward opening 20. As best seen in FIG. 3, member 19 has a depression or notch 23 on the cam surface 22, an adjacent projecting detent 24 and a vertical face 25 at the end of the cam surface 22. Opening 20 in latch member 19 is hexagonal. Latch member 19 fits into the slot in member 16, with its opening 2 aligned with opening 17 in member 16 and with hole 13.

An elongated locking rod in the form of hexagonal rod 30 slides into hole 13 through openings 17 and 20, so that the inner end of rod 30 extends into the interior of the casket 10, where it receives metal clip 30*a* to hold it against slipping out. The metal clip 30*a* bears against the inside surface of the casket. The outer end of rod 30 has a narrow flange 30*b* which engages a depressed area 13*a* in the outer surface of shell 11 at the outer end of hole 13 to limit inward movement of the rod 30. Rod 30 has a hexagonal axial bore 31 to receive a conventional casket key (not shown), which may be used to rotate rod 30. The hexagonal exterior cross section of rod 30 matches the hexagonal opening 20 in latch 19 so that rotation of rod 30 rotates the latch.

Figure 4:
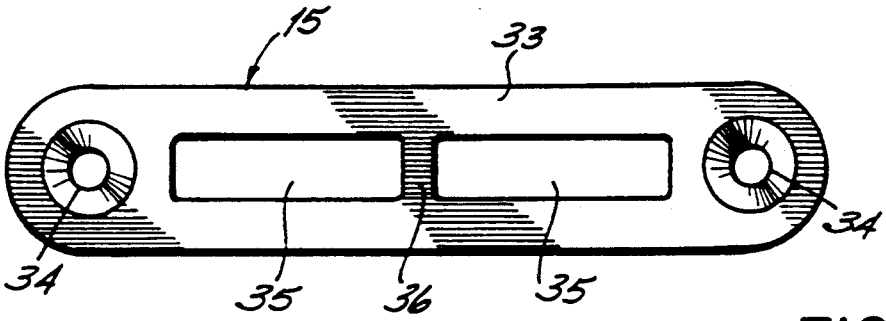

Set into the edge of the cap 12 at location 15 is an elongated, flat rim pin 33 (FIG. 4) which is conveniently of stamped metal. Rim pin 33 has screw holes 34 near each end for attachment to the cap 12, and two longitudinally-extending openings 35 separated by a central transversely-extending solid section 36 forming a keeper, which extends generally parallel to the axis of rotation of rod 30 when the cap is closed. This section 36 is the keeper that is engaged by ca surface 22 of latch 19. The edge portion of cap 12 behind member 33 is conveniently hollowed out to provide room for hook-like arm 21 to pass behind keeper 36 and bring cam surface 22 into engagement with keeper section 36.

After providing hole 13 and slot 14 in the casket shell 11, located as shown in FIGS. 1 and 2, slotted member 16 is placed in slot 14, the function of member 16 being primarily aesthetic to cover slot 14, which has been routed out. Member 16 also provides better guidance and more accurate positioning for latch member 19. Latch 19 is then placed in the slot in member 15 with its' hook-like portion 21 extending upwardly. Rod 30 is inserted into hole 13 from outside the shell, passing through hole 20 in latch 10, and finally being stopped in its inward movement by snug engagement of flange 30*b* with shell 11 at the location of depressed area 30*b*. In this position, the outer end of rod 30 is substantially flush with the exterior surface of the shell. Depressed area 30*b* may be eliminated if such flush positioning is not required. The inner end of rod 30 extends into the interior of the shell far enough to be engaged by clip 30*a* which prevents the rod from slipping out of opening 13.

A rim pin 33, which is a flat stamped plate, is attached to the edge of the casket cap 12 at position 15 which places it directly over the locking mechanism in the edge of shell 11 when the cap is closed. The rim pin has two longitudinal openings 35 that define between them a transverse keeper 36. The openings are positioned so that hook-like arm 21 can enter one of these openings, move above the keeper 36 and then exit through the other opening 35 as latch 19 is rotated by turning of rod 30.

Continued rotation of latch 19 causes cam surface 22 to move along keeper 36, pulling it and the cap against the shell until detent 24 on the arm snaps over keeper 36, informing the user by sound and/or feel that latching has been accomplished and keeper 36 has come to rest in depression 23 on the cam surface. Further rotation of latch 19 is prevented by face 25 at the end of the cam-engaging keeper 36. In this position as best seen in FIG. 3, there is a small gap, e.g., on the order of 0.050 inch, between the edge of the casket cap 12 and the facing edge of the shell 11. Since the casket 10 is typically made of wood, it is desirable that the facing edges of the cap 12 and shell 11 not rub on each other. To this end, small (e.g., ½ inch diameter) felt pads can be spaced on the shell 11 edge which are tightly compressed as the cam surface 22 of latch 19 moves along keeper 36. It will be recognized that the facing edges of the cap 12 and shell 11 could, if desired, be brought into intimate contact by proper dimensioning of the latch 19. However, as stated, provision can be made for a slight gap therebetween to accommodate a soft material therein to prevent rubbing between the facing edges. Both constructions are contemplated by this invention; and, accordingly, use herein of the words "abutting" of the upper and lower edges, pulling of the lid "tight" or "tightly" against the shell and the like, is intended to encompass both constructions.

The mechanism is thus easily assembled and suitable for mass production. It is also simple to operate and positive in its locking action.

The invention has been described with reference to a preferred embodiment. However, it will be appreciated that variations and modifications can be effected within the ordinary skill of the art without departing from the scope of the invention as defined by the appended claims.

I claim:

1. A lock for a hardwood casket comprising:

a vertical casket wall having an upper edge, said wall having a vertical slot projecting from said upper edge downwardly into said wall and said wall having a transverse hole therethrough that passes through said slot, an insert member having a flat vertical slot and a transverse hole, said insert member being disposed in the slot in said wall with said transverse holes aligned, a hook-shaped latch in said insert member slot, said latch having an irregularly shaped hole aligned with said transverse holes, a locking rod of a cross section mating with said irregularly shaped hole and passing through all said holes, means blocking axial movement of said locking rod with respect to said wall, said casket having a lid with a lower edge abutting said upper edge, and a keeper mounted on and lying flush with said lower edge in a position for engagement by said hook-shaped latch to pull said lid tight against said upper edge of said vertical casket wall.

2. A locking mechanism for a hardwood burial casket of the type having shell and cap portions which face edge-to-edge when the casket is closed comprising;

an elongated slot projecting into an edge of one of said portions, a slotted member having an internal slot and positioned in said elongated slot and conforming closely to the inner surface and depth of said elongated slot, a hole extending from the outside of said one portion into communication with said internal slot, latch means in said internal of said slotted member said latch means having an opening therein and a hook-like arm provided with a cam surface facing in the direction of said opening, a rotatable, elongated locking member insertable into said hole from outside the casket and into driving engagement with the opening in said latch means, said slotted member having a transverse opening therein to receive said locking member, and keeper means located on and lying flush with a facing edge of the other casket portion and engageable by said hook-like arm to cause the two casket portions to be pulled tightly together by action of said cam surface on said keeper upon rotation of said latch means by rotation of said locking member.

3. Locking mechanism as set forth in claim 2, further comprising, said cam surface having a depression defining the final locked position of said keeper means, and a projecting detent section which engages said keeper means before said depression engages said keeper means.

4. Locking mechanism as set forth in claim 3, further comprising;

said latch means having a face at the inner end of the cam surface to assure against overtightening.

5. Mechanism as set forth in claim 2 further comprising:

said keeper means comprising a member extending generally parallel to the axis of rotation of said latch means.

6. Mechanism as set forth in claim 5 further comprising:

said keeper means further comprising an elongated, flat part having two longitudinally-extending openings separated by a transversely-extending.

7. Mechanism as set forth in claim 2, said elongated slot being in an edge of the shell portion of the casket and keeper means being on said cap portion.

8. Mechanism as set forth in claim 2 further comprising:

said locking member and the opening in said latch means being multi-sided and complementary.

9. Mechanism as set forth in claim 2 further comprising;

said locking member having an axial bore to receive an operating key.

10. Mechanism as set forth in claim 2 further comprising;

said locking member having a flange at its outer end which fits snugly within said hole, with the outer end of the locking member flush with the outer surface of the casket

11. Mechanism as set forth in claim 2 further comprising;

said locking member extending into the interior of the casket, and means engaging the inner end of the locking member to retain the locking member in the assembled position.

12. Locking mechanism for a hardwood burial casket of the type having a shell having an upper edge and a cap having a lower edge which face edge-to-edge when the casket is closed comprising:

means providing an elongated slot in the upper edge of said shell, means providing a hole extending from the outside of the shell into said slot and into communication with the interior of the casket, a latch member having an opening therein and a hook-like arm provided with a cam surface facing in the direction of said opening, a slotted member positioned in said elongated slot and conforming closely to said elongated slot, said slotted member having a transverse opening therein aligned with said hole, said latch means being located in said slot, a rotatable, elongated locking member insertable from outside the casket into the hole in said shell and through the opening in said slotted member into driving engagement with the opening in said latch means, said locking member having an outer end that has means for limiting inward movement thereof, said locking member having an inner end extending into the interior of the casket, means engaging said inner end of said locking member to retain it against outward movement with respect to said shell, and keeper means located on and lying flush with a facing edge of the cap for engagement by said hook-like arm to cause the cap and shell to be pulled tightly together by action of said cam surface upon rotation of said latch means by rotation of said locking member, said keeper means comprising an elongated, flat part set into the edge surface of the cap and having two elongated openings separated by a transversely extending section which is engaged by said hook-like arm.

13. Locking mechanism as set forth in claim 12 further comprising;

the cam surface on said hook-like arm having a depression defining a final locked position of said keeper means, a projecting detent which engages the keeper means before the latter engages said depression, and a face at the inner end of the cam surface to assure against overtightening.

14. Locking mechanism as set forth in claim 12 further comprising;

said locking member having an axial bore to receive an operating key.

* * * * *

UNITED STATES PATENT AND TRADEMARK OFFICE

CERTIFICATE OF CORRECTION

PATENT NO. : 5,060,993

DATED : October 29, 1991

INVENTOR(S) : Donald R. Maier

It is certified that error appears in the above-identified patent and that said Letters Patent is hereby corrected as shown below:

Column 2, line 54, "asethetic" should be -- aesthetic -- .

Column 3, line 2, "ar" should be -- arm -- .

Column 3, line 3, before "and" insert -- keeper; -- .

Column 3, line 36, "opening 2" should be -- opening 20 -- .

Column 3, line 60, "ca" should be -- cam -- .

Column 4, line 3, delete apostrophe after "its".

Column 5, line 28, after "internal" insert -- slot -- .

Column 5, line 63, after "transversely-extending" insert -- section -- .

Signed and Sealed this

Eleventh Day of May, 1993

*Attest:*

Michael K. Kirk

MICHAEL K. KIRK

*Attesting Officer*

*Acting Commissioner of Patents and Trademarks*